United States Patent [19]

Van Alphen

[11] 3,952,227

[45] Apr. 20, 1976

[54] CATHODE-RAY TUBE HAVING ELECTROSTATIC FOCUSING AND ELECTROSTATIC DEFLECTION IN ONE LENS

[75] Inventor: Willem Meijndert Van Alphen, Netherlands

[73] Assignee: U.S. Philips Corporation, New York, N.Y.

[22] Filed: Nov. 26, 1974

[21] Appl. No.: 527,250

Related U.S. Application Data

[63] Continuation of Ser. No. 416,241, Nov. 15, 1973, abandoned.

[30] Foreign Application Priority Data

Apr. 9, 1971 Netherlands ..... 7104835

[52] U.S. Cl. ..... 315/17; 315/382; 313/432; 313/449

[51] Int. Cl.[2] ..... H01J 29/70; H01J 29/74

[58] Field of Search ..... 313/432; 315/17, 382

[56] References Cited

UNITED STATES PATENTS

| | | | |
|---|---|---|---|
| 2,424,965 | 8/1947 | Brillouin | 313/427 |
| 2,627,587 | 2/1953 | Kohler | 313/432 X |
| 2,681,426 | 6/1954 | Schlesinger | 313/432 |
| 2,781,171 | 2/1957 | Hagen | 313/432 X |
| 2,911,563 | 11/1959 | Atti et al. | 315/17 |
| 3,124,790 | 3/1964 | Kuehler | 360/116 |
| 3,320,468 | 5/1967 | Glenn | 313/426 |
| 3,358,174 | 12/1967 | Glenn | 313/448 |
| 3,397,341 | 8/1968 | Guyot et al. | 313/432 X |
| 3,731,136 | 5/1973 | Roussin | 315/16 |

*Primary Examiner*—Robert Segal

*Attorney, Agent, or Firm*—Frank R. Trifari; George B. Berka

[57] ABSTRACT

A cathode-ray tube having electrostatic focusing and electrostatic deflection lens which comprises three cylindrical electrode arranged along a common axis. The end electrodes are supplied by a high focusing voltage and the intermediate electrode is divided into at least three segments, each being supplied by a voltage which is a linear combination of a lower focusing voltage and of two deflection voltages.

1 Claim, 3 Drawing Figures

Figure 1:
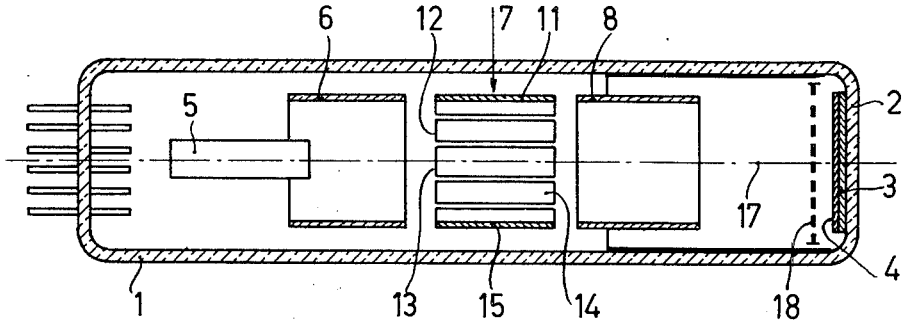

CATHODE-RAY TUBE HAVING ELECTROSTATIC FOCUSING AND ELECTROSTATIC DEFLECTION IN ONE LENS

This is a continuation, of application Ser. No. 416,241, filed Nov. 15, 1973, now abandoned.

The invention relates to a cathode-ray tube comprising means for producing an electron beam, a target and a focusing lens for focusing the electron beam onto the target, said focusing lens comprising at least two electrodes, one of said electrodes consisting of at least two parts for deflecting the electron beam.

Such a cathode ray tube is known from the U.S. Pat. No. 2,911,563. It is stated in said Patent Specification how an electrostatic focusing lens can also be used for deflecting the electron beam. One of the electrodes of the focusing lens consists of two parts. Different voltages are supplied to said parts. The average of said voltages is the voltage which the electrode has to convey to cause the lens to operate as a focusing lens. The difference of said voltages produces a field strength normal to the axis of the tube to deflect the electron beam.

The deflection however, which can be obtained in this manner is only small and serves, for example, for readjustment and an electromagnetic deflection system should be present for larger deflection.

It is the object of the invention to provide a cathode-ray tube having a focusing lens which also serves for the deflection of the electron beam and in which the deflection in two different directions takes place in the same region along the axis of the tube. Another object of the invention is to provide means by which the deflecting field is considerably homogeneous and is proportional to the deflection voltages.

According to the invention, in a cathode-ray tube of the type mentioned in the preamble, one of the electrodes of the focusing lens consists of at least three mutually insulated segments for deflecting the electron beam in two directions and all the other electrodes of the focusing lens each constitute electrically one conductor.

The invention is based on the recognition of the fact that it is possible that an electrode of a focusing lens may also serve for the deflection of the electron beam in two directions by dividing said electrode into at least three segments and supplying to each segment a voltage which is a linear combination of three voltages, namely of the focusing voltage and of the two deflection voltages for the said two directions.

In a cathode-ray tube according to the invention, one of the electrodes of the focusing lens preferably consists of at least eight mutually insulated segments.

In fact, investigations have demonstrated that it is possible by means of an octupole to obtain deflection fields which are considerably homogeneous as a result of which very few aberrations are formed in the electron beam.

It has proved possible to construct a cathode-ray tube according to the invention in which the electrodes of the focusing lens are cylindrical electrodes and in which the segments of one of the electrodes have parallel edges at the axis of the focusing lens.

In this manner, a very simple construction of the tube is possible.

A very simple construction of a cathode-ray tube according to the invention is such that the focusing lens consists of three circular cylindrical electrodes of the same diameter and that the central one of said electrodes consists of eight equal segments which extend parallel to the axis of the focusing lens.

The advantages of said construction will become apparent from the following embodiment to be described.

Figure 2:
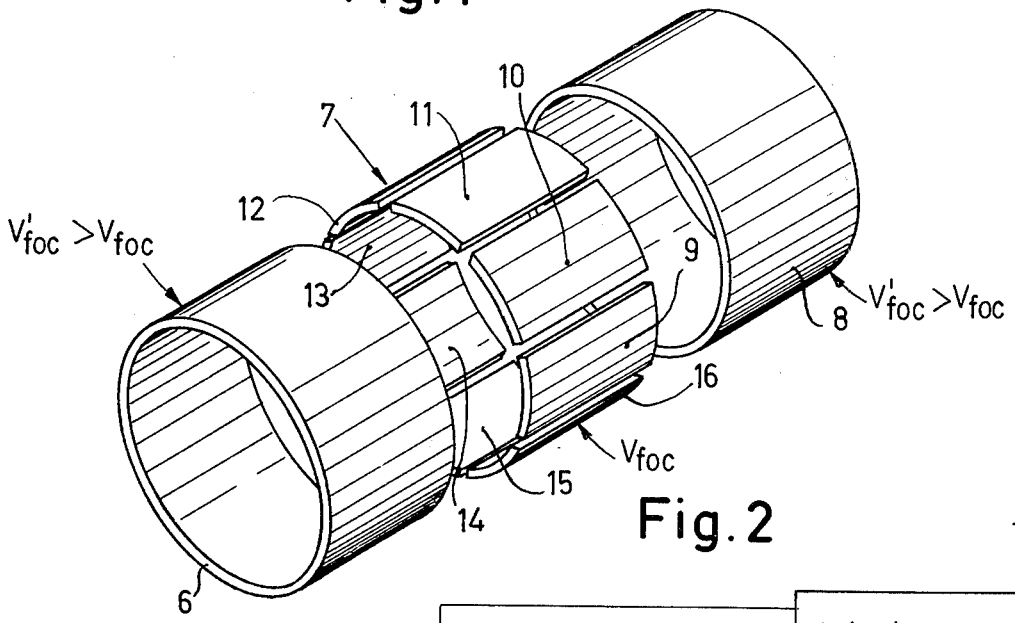
Figure 3:
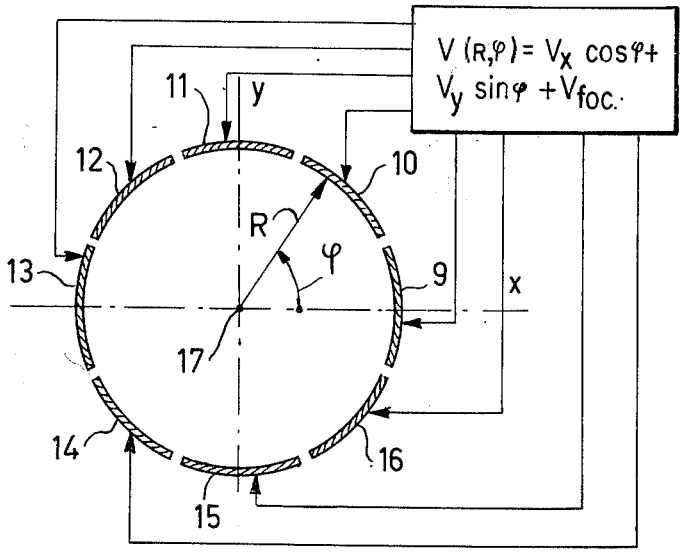

In order that the invention may be readily carried into effect, it will now be described in greater detail with reference to the accompanying drawing of an embodiment of which FIG. 1 is a longitudinal sectional view of a cathode-ray tube according to the invention FIG. 2 shows the focusing lens of said tube, and FIG. 3 is a sectional view through an electrode of said lens.

The cathode-ray tube shown in FIG. 1 is a television camera tube. However, the invention is by no means restricted to such a tube but may be used in all cases in which it makes sense to combine the deflection and focusing in one lens. The tube shown in FIG. 1 comprises a glass envelope 1 having a transparent front plate 2 on which a transparent conductive layer 3 and a photoconductive layer 4 have been provided. The tube comprises an electron gun 5 and a focusing lens consisting of three electrodes 6, 7 and 8 shown diagrammatically. The electrode 7 is constructed from eight segments 9 to 16, the segments 11 to 15 being visible in FIG. 1 and the segments 9, 10 and 16 being situated in front of the plane of the drawing. The tube furthermore comprises a gauze electrode 18. The axis of the tube is denoted by 17. The focusing lens (6, 7 and 8) serves to focus the electron beam produced by the electron gun 5. The gauze electrode 18 serves to produce 90° landing of the beam on the layer 4. The charging by photo-conduction of the layer 4 locally depends upon the optic image to be projected on the layer 4. The discharge of the layer 4 by the electron beam, until said layer has again reached the potential of the electron gun, thus is also locally dependent upon the projected image. By causing the electron beam to scan the layer 4, an image signal is obtained which can be derived from the layer 3.

Such a camera tube is termed a vidicon and if the layer 4 is manufactured from specially activated lead oxide, the tube is termed a "Plumbicon." The already mentioned scanning of the layer 4 by the electron beam occurs by deflecting the electron beam by means of deflection voltages on the segments 9 to 16. Said deflection voltages are superimposed upon a focusing voltage to be supplied to the segments. The focusing voltage is the voltage which is necessary on the electrode 7 to produce the desirable focusing in combination with the voltages at the electrodes 6 and 8.

For further illustration, FIG. 2 is a perspective view of the focusing lens.

FIG. 3 is a sectional view of the electrode 7 normal to the axis 17 of the tube. The segments 9 to 16 are visible in the figure. The electrode 7 is circular cylindrical and has a radius R. The deflection directions are denoted by the axes $x$ and $y$. The deflection voltages associated with the deflection devices are termed $V_x$ and $V_y$. The focusing voltage on the electrode 7 is termed $V_f$. The direction of the overall deflection in the two directions relative to the plane through the axes $x$ and 17 is denoted in the figure by the angle $\phi$. The gap between the segments is small relative to their width. As a result of this, each segment comprises an angle of slightly less than 45°. An average value of $\phi$ can be allotted to each of the segments. For segment 9, $\phi = 0$; for segment 10, $\phi = 45°$; for segment 11, $\phi = 90°$; and so on. If the potential within the cylinder having radius R can be written as $$V(x,y) = (x/R) \cdot V_x + (y/R) \cdot V_y + V_f,$$

then the electric field strength in the $x$-direction is $E_{xV} = (V_x/R)$ and the electric field strength in the $y$-direction is $E_y = (y/R)$. These field strengths are then independent of the location within the cylinder and hence the deflection fields then are homogeneous and proportional to $V_x$ and $V_y$, respectively. On the cylinder having radius R, $x = R \cdot \cos \phi$ and $y = R \cdot \sin \phi$ and hence it must apply on the cylinder that $$V(R, \phi) = V_x \cdot \cos \phi + V_y \cdot \sin \phi + V_f.$$

It has been found that if a voltage of the value $V_x \cdot \cos \phi + V_y \cdot \sin \phi + V_f$, in which $\phi$ is the above-mentioned average value of $\phi$ for the relevant segment, is supplied to each of the segments 9 to 17, a deflection field is obtained which theoretically is homogeneous only upon an approximation, it is true, but is considerably homogeneous in practice. By giving the voltages on the segments slightly deviating values, said homogeneity can even be improved. Moreover, dynamic focusing voltages, that is to say voltages dependent upon the deflection, can be supplied to the segments to improve the focusing and minimize any lens defects. Although in the chosen embodiment the electrode 7 consists of eight segments, the invention is not restricted to this number of segments. However, the number of segments should be at least three to enable independent deflection in two different directions. Nor is the invention restricted to a focusing lens having three electrodes, although it is favourable to use a three-element unipotential lens having a high focusing voltage $V_f$ on end electrodes 6 and 8, and a lower electrode 7, because in that case it is simpler to superimpose the voltages $V_x \cdot \cos \phi$ and $V_y \cdot \sin \phi$ for the various segments on $V_f$. In addition, small deflection voltages are sufficient in connection with the low speed of the electrons of the electron beam upon passing the central electrode. In other words: a large deflection sensitivity is obtained. An additional favourable effect is that compensation occurs of an undesirable focusing occurring as a result of the deflection. Actually, a homogeneous deflection field itself has a focusing influence on an electron beam, which focusing depends upon the deflection, and therefore causes image field curvature. The focusing lens according to the invention, however, becomes weaker in the direction of the deflected beam as a result of which the said compensation occurs.

What is claimed is:

1. A cathode ray tube comprising:

a. means for producing an electron beam;

b. a target for intercepting said electron beam;

c. electrostatic focusing means for focusing said electron beam onto said target, said focusing means being disposed between said electrode beam producing means and said target and comprising three electrodes, a first and second ones of said electrodes having respective integral structures and the third one of said electrodes being disposed between said first and second electrodes and comprising at least two pairs of separate longitudinal segments arranged in orthogonal coordinates x and y perpendicular to and intersecting at the axis of said focusing means, said segments being mutually electrically insulated from each other and extending parallel to the axis of said focusing means, said first, second and third electrodes being cylindrical and having substantially equal diameters;

d. means for applying a higher focusing potential $V'_f$ to said first and second electrodes and a lower focusing potential $V_f$ to each segment of said third electrode, and e. means for superimposing deflection potentials upon said lower focusing potential to produce on each segment a combined voltage $V\ R,\phi = +V_x \cos\phi + V_Y \sin \phi + V_f$, where R is the radius and $\phi$ is an angle of deflection assigned to respective segments with respect to said coordinates.

* * * * *